US008214978B1

(12) United States Patent
Moran

(10) Patent No.: US 8,214,978 B1
(45) Date of Patent: Jul. 10, 2012

(54) BURIAL CAPSULE

(76) Inventor: Robin A. Moran, Stone Mountain, GA (US)

( * ) Notice: Subject to any disclaimer, the term of this patent is extended or adjusted under 35 U.S.C. 154(b) by 15 days.

(21) Appl. No.: 12/821,227

(22) Filed: Jun. 23, 2010

Related U.S. Application Data

(60) Provisional application No. 61/269,260, filed on Jun. 23, 2009.

(51) Int. Cl.
*A61G 17/00* (2006.01)

(52) U.S. Cl. ..... 27/14; 27/15; 27/DIG. 1; 220/345.2; 49/449

(58) Field of Classification Search ..... 27/14, 15, 27/17, DIG. 1, 2; 220/252, 324, 345.2, 345.5, 220/345.6; 49/449
See application file for complete search history.

(56) References Cited

U.S. PATENT DOCUMENTS

| | | | | | |
|---|---|---|---|---|---|
| 204,320 | A | * | 5/1878 | Hamilton | 27/15 |
| 377,355 | A | * | 1/1888 | Duell et al. | 292/303 |
| 545,176 | A | * | 8/1895 | Ruebekam | 27/15 |
| 2,579,756 | A | | 12/1951 | Reed | |
| 2,811,768 | A | | 11/1957 | Axelson | |
| 2,835,955 | A | | 5/1958 | Snyder | |
| 3,317,097 | A | * | 5/1967 | Giordano | 224/182 |
| 3,470,593 | A | * | 10/1969 | Baron | 27/15 |
| 3,654,676 | A | | 4/1972 | McHugh | |
| 3,898,718 | A | | 8/1975 | Eubank | |
| 3,924,309 | A | | 12/1975 | Andrus, Jr. et al. | |
| 5,042,683 | A | * | 8/1991 | Shaw et al. | 220/345.3 |
| 5,127,112 | A | | 7/1992 | Brock | |
| 5,222,281 | A | | 6/1993 | Guérin | |
| 5,471,718 | A | * | 12/1995 | Harrill | 27/7 |
| 5,659,932 | A | | 8/1997 | Wright | |
| D420,193 | S | | 2/2000 | Cummings | |
| 6,138,831 | A | * | 10/2000 | Agostinelli | 206/541 |
| D551,425 | S | | 9/2007 | Layle | |
| 2007/0062953 | A1 | * | 3/2007 | Lin | 220/345.5 |

* cited by examiner

*Primary Examiner* — William L. Miller
(74) *Attorney, Agent, or Firm* — Montgomery Patent & Design, LLC; Robert C. Montgomery; Joseph T. Yaksich

(57) ABSTRACT

A burial casket shaped as a capsule opened by sliding two (2) halves of the capsule lid outwardly, thereby allowing the option of a half-open, fully-open, or fully-closed configuration. The capsule lids would be provided a securing means to prevent inadvertent opening and carrying handles would be provided. These features provide for a casket that is of a lower cost and smaller size, yet still provides a respectful viewing means for the deceased.

12 Claims, 7 Drawing Sheets

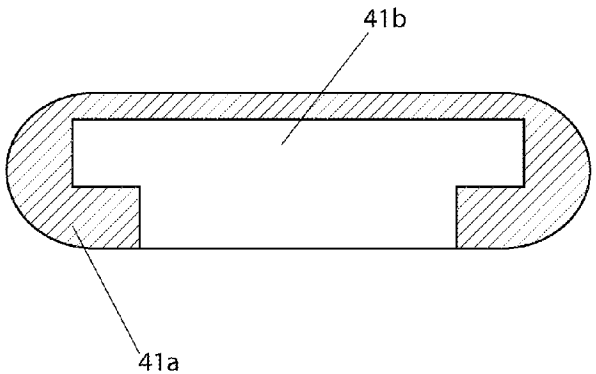
Fig. 7
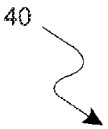

BURIAL CAPSULE

RELATED APPLICATIONS

The present invention was first described in and claims the benefit of U.S. Provisional Application No. 61/269,260 filed Jun. 23, 2009, the entire disclosures of which are incorporated herein by reference.

FIELD OF THE INVENTION

The present invention relates generally to burial vessels, and in particular, to a coffin adapted for ease of manipulation and efficient use of space.

BACKGROUND OF THE INVENTION

Ceremonies associated with death have constituted some of the most important rituals in human existence. While many various traditions, observations, and methods of interment exist around the world, perhaps one of the most popular is the use of coffins and similar interment vessels utilized to contain and protect the bodies of the deceased. Such coffins are commonly associated with burial rituals such as placement under coffins, in graveyards or other burial sites, and the like.

While such burial vessels are of significant cultural and spiritual significance, many practical problems result from their use. One (1) of the most prominent growing issues with such devices is that of their size and shape. It is considered important that such sites remain sacred and undisturbed for an indefinite period of time. However, the placement of large or bulky interment vessels accelerates the pace at which burial sites are filled up. Due to the finite nature of space on earth, this problem becomes more and more significant as time goes on. Furthermore, such vessels are inconvenient or undesirable with regards to transportation, cost associated with expensive burial space, cost associated with materials of the vessel itself, and the like. While alternate methods of corporal preservation, such as cremation, have become popular alternatives to mitigate these types of problems, many persons consider coffin-type vessels to be an important symbolic or spiritual aspect of an interment ceremony.

Various attempts have been made to provide interment vessels such as coffins. Examples of these attempts can be seen by reference to several U.S. patents, including U.S. Pat. No. 2,579,756; U.S. Pat. No. 2,835,955; U.S. Pat. No. 3,924,309; and U.S. Pat. No. 5,222,281.

Additionally, ornamental designs for a coffin exist, such as U.S. Pat. Nos. D 420,193 and D 551,425. However, none of these designs are similar to the present invention.

While these devices fulfill their respective, particular objectives, each of these references suffer from one (1) or more of the aforementioned disadvantages. Traditionally, many such coffins take the form of large, generally rectangular shapes which are large and difficult to maneuver. Also, many such traditional coffins are heavy which aggravates these types of difficulties. Furthermore, many such vessels are cost prohibitive due to their size, materials, construction, or ornamentation. In addition, many such devices are of a construction which makes them difficult to use, position, or configure in a desired manner. Accordingly, there exists a need for a burial coffin without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a burial vessel which makes efficient and comfortable use of space in a manner which allows for ease of use and configuration while providing features and advantages of a traditional coffin. Thus, the object of the present invention is to solve the aforementioned disadvantages and provide for this need.

To achieve the above objectives, it is an object of the present invention to provide a means to display, secure, and transport deceased remains in the manner of a traditional coffin.

Another object of the present invention is to provide a means for an economical retention and burial enclosure which is cost and space efficient.

Yet still another object of the present invention is to adapt closely to a human form, providing comfortable securement to a body as well as requiring less burial ground. The device takes a generally cylindrical form of a length similar to a conventional coffin.

Yet still another object of the present invention is to provide various configurations such as open, partially open, or closed in order to allow various desired states during ceremonial proceedings. The device comprises a top portion which is slidingly removably attachable to a bottom portion. The top portion further comprises two (2) separable lid portions covering the head and foot portions of an interred person, respectively, and allowing for selective exposure of neither, either or both halves of the interior of the device as desired.

Yet still another object of the present invention is to provide secure closure to an enclosed corpse via a latching means between the two (2) lids of the top portion.

Yet still another object of the present invention is to provide further secure closure to an enclosed corpse via a tongue-and-groove type sliding fitting connection between the top and bottom portions and a cap for locking the lids in place, thereby providing a unitary circular or ovular profile to the device. The sliding fitting connection further comprises a gasket for airtight closure.

Yet still another object of the present invention is to enable convenient lifting and movement of the device in a conventional manner via integrally molded handles.

Yet still another object of the present invention is to enable the device to be displayed in a desired level location for traditional viewing or burial ceremonies via a base support which provides a flat bottom surface and a sliding fitting means for the bottom portion of the device.

Yet still another object of the present invention is to provide a horizontal surface interior to the bottom portion for positioning of the deceased remains. The interior of the bottom portion may further house a variety of ceremonial items or the like.

Yet still another object of the present invention is to provide a method of utilizing the device that provides a unique means of removing the caps and lid portions, positioning deceased remains and ceremonial items with the bottom portion and the contained horizontal surface, disposing the lids in a desired configuration for various ceremonial proceedings, providing a means for positioning the device on a flat surface via engagement of the bottom portion with the base support, providing secure closure to the device via the sliding attachments, latches, and caps, easily transporting the device in a conventional manner via the handles, and providing space efficient interment as a result of the shape of the device.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

| | |
|---|---|
| 10 | burial capsule |
| 20 | top portion |
| 21 | lower portion |
| 22 | first lid |
| 24 | second lid |
| 30 | side handle |
| 35 | end handle |
| 40 | latch means |
| 41a | cap |
| 41b | aperture |
| 42 | first ledge |
| 43 | second ledge |
| 44 | first protrusion |
| 45 | second protrusion |
| 49 | gasket seal |
| 50 | base portion |
| 51 | slide fitting means |
| 55 | base support |
| 60 | horizontal surface |
| 65 | pillow |

DETAILED DESCRIPTION OF THE PREFERRED EMBODIMENT

The best mode for carrying out the invention is presented in terms of its preferred embodiment, herein depicted within FIGS. 1 through 7. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

Figure 1:
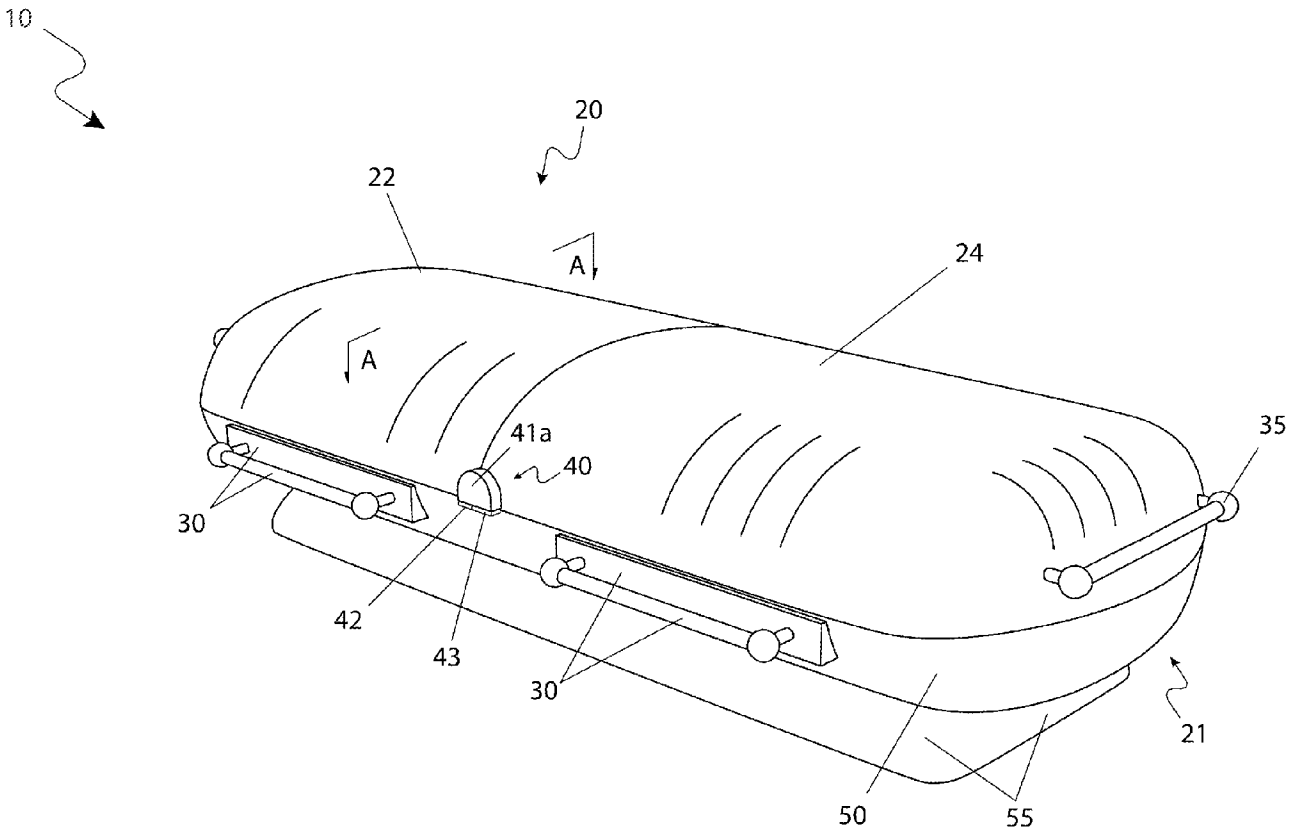
FIG. 1 is a perspective view of a burial capsule 10, according to a preferred embodiment of the present invention.

The present invention describes a burial capsule (herein described as the "apparatus") 10, which provides a means for an economical and contemporary retention and burial enclosure. The apparatus 10 comprises a cylindrical form which adapts more closely to a human shape, hence requiring less burial ground. Referring now to FIG. 1, a perspective view of the apparatus 10, according to the preferred embodiment of the present invention, is disclosed. The apparatus 10 also comprises a top portion 20 and a lower portion 21 which provides a means to display, secure, and transport deceased remains. The apparatus 10 is fabricated from durable materials such as, but not limited to: fiberglass, steel, wood or the like. The apparatus 10 is preferably available in a variety of colors, styles, and sizes to correspond to various requirements and desires of a deceased person and all others involved. The apparatus 10 is utilized similar to conventional caskets or coffins, yet comprises innovative features, enhanced functionality, and a cost effective design.

Figure 2:
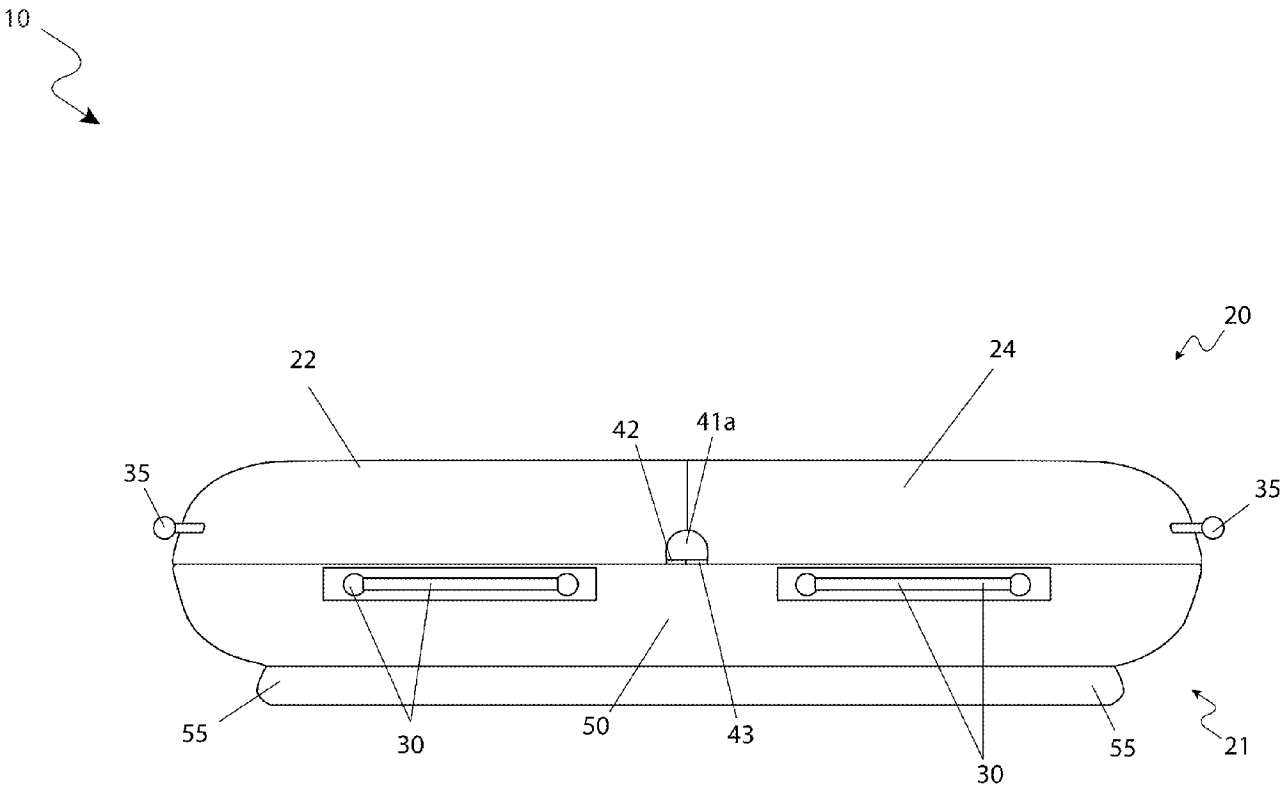
FIG. 2 is a side view of the burial capsule 10 depicting a closed state, according to a preferred embodiment of the present invention.
Figure 3:
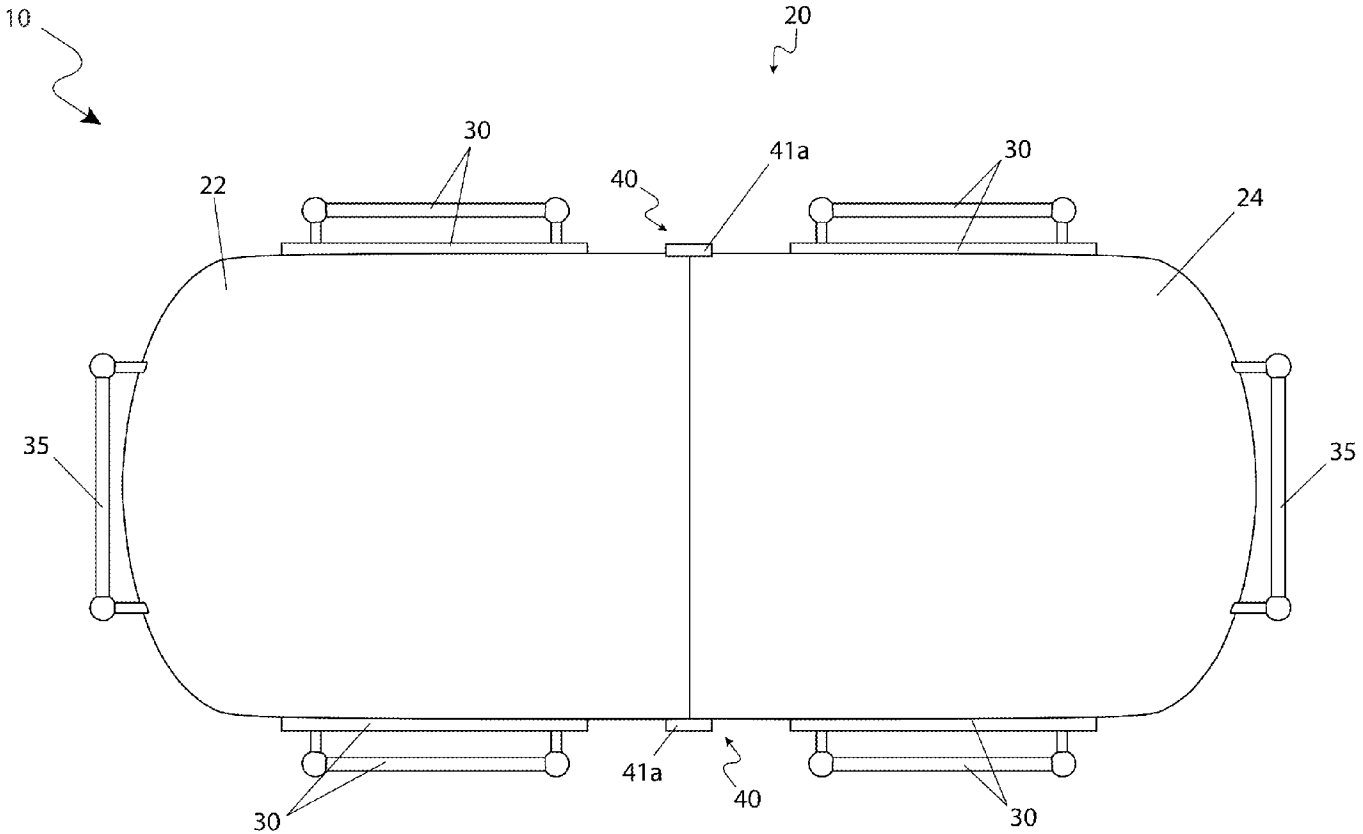
FIG. 3 is a top view of the burial capsule 10, according to a preferred embodiment of the present invention.
Figure 4:
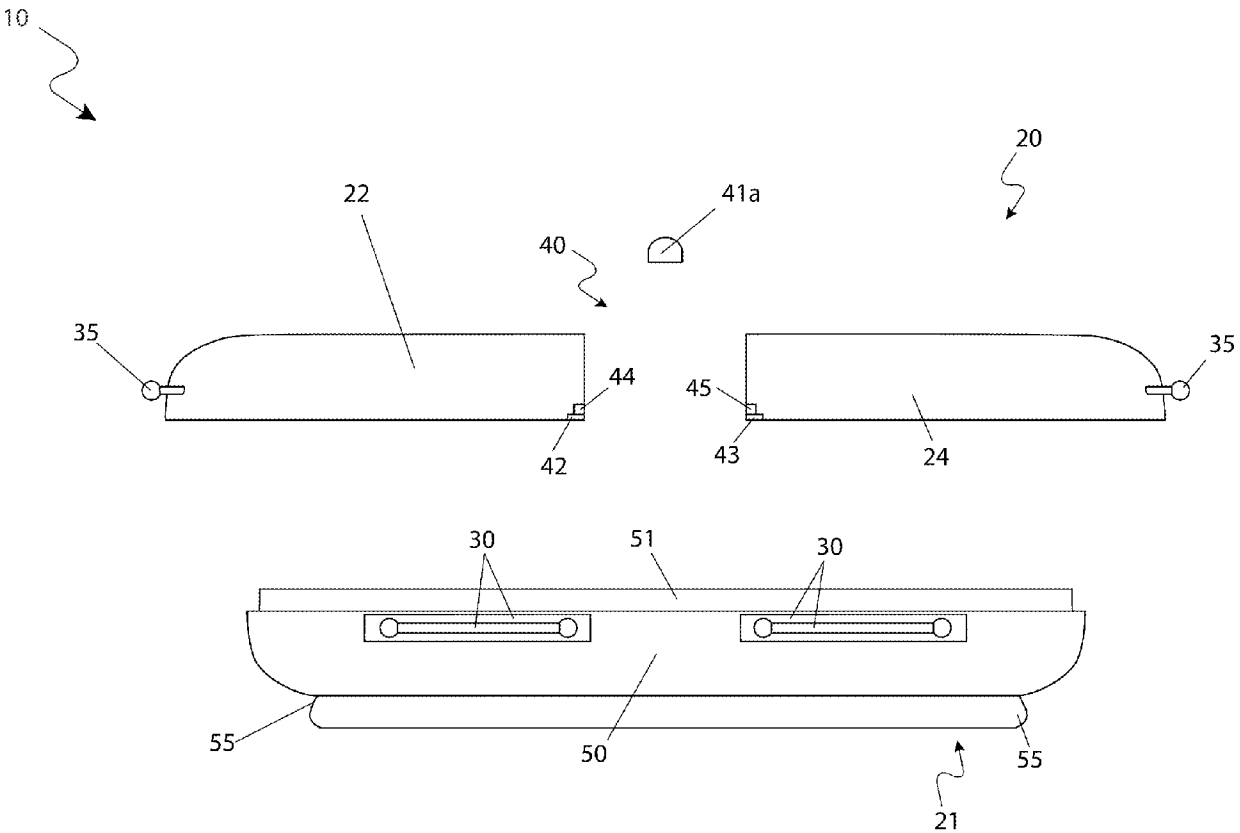
FIG. 4 is an exploded front view of the burial capsule 10, according to a preferred embodiment of the present invention.

Referring now to FIG. 2, a side view of the apparatus 10 depicting a closed state, FIG. 3, a top view of the apparatus 10, and FIG. 4, an exploded front view of the apparatus 10, according to the preferred embodiment of the present invention, are disclosed. As abovementioned the apparatus 10 comprises a top portion 20 and a lower portion 21 which provides a means to display and contain deceased remains. The top portion 20 comprises a first lid 22, a second lid 24, and a pair of end handles 35. Each lid 22, 24 comprises a semi-circular shape and is divided equally in two (2) halves. The lids 22, 24 enable the apparatus 10 to be orientated in an open, a partially open, or a closed position which provide various desired states during ceremonial proceedings. The first lid 22 is located above a head portion of the deceased and the second lid 24 is located above a feet portion of said deceased. The first lid 22 mirrors the second lid 24 and both are slidably removably attachable to a slide fitting means 51 (also see FIG. 5). Each lid 22, 24 is also fastened to one (1) another via a latching means 40 (also see FIGS. 6 and 7). The latching means 40 comprises associated components which enable a person to secure the lids 22, 24 in a closed state (see FIG. 2). Each lid 22, 24 comprises an end handle 35 which provide a means to grasp each said lid 22, 24 for placement or removal. The end handles 35 are integrally molded into each lid 22, 24 and comprise an appropriate strength, length, and circumference to support the lids 22, 24 and enable person's hands to grip and exert a sufficient force to pull and lift said lids 22, 24. An end handle 35 is located on an outer surface of each lid 22, 24 in an intermediate orientation.

The lower portion 21 also comprises a semi-circular shape of equal dimensions of the top portion 20 and provides a means to position and display the deceased remains and attach the top portion 20. The lower portion 21 comprises a base portion 50 and a base support 55 which provides a means to support the deceased remains and the apparatus 10. The base portion 50 comprises the slide fitting means 51 means to each lid 22, 24 (see FIG. 5) which enables said lids 22, 24 to be removed or attached. Each outer side surface of the base portion 50 comprises a pair of side handles 30 which provide a means to grasp the apparatus 10 for lifting and transporting to a desired location. Each side handle 30 is integrally molded into the base portion 50, are equally spaced, and comprise a tubular-shape to enable the user to grasp said side handles 30 in a common manner for a desired outcome. The side handles 30 are an appropriate strength, length, and circumference to support the apparatus 10 and enable person's hands to grip and exert a sufficient force to lift and carry said apparatus 10. The base support 55 is attached to the base portion 50 preferably via integral molding and provides a stabilizing means for resting the apparatus 10 on a level display platform or the like in a stationary position.

Figure 5:
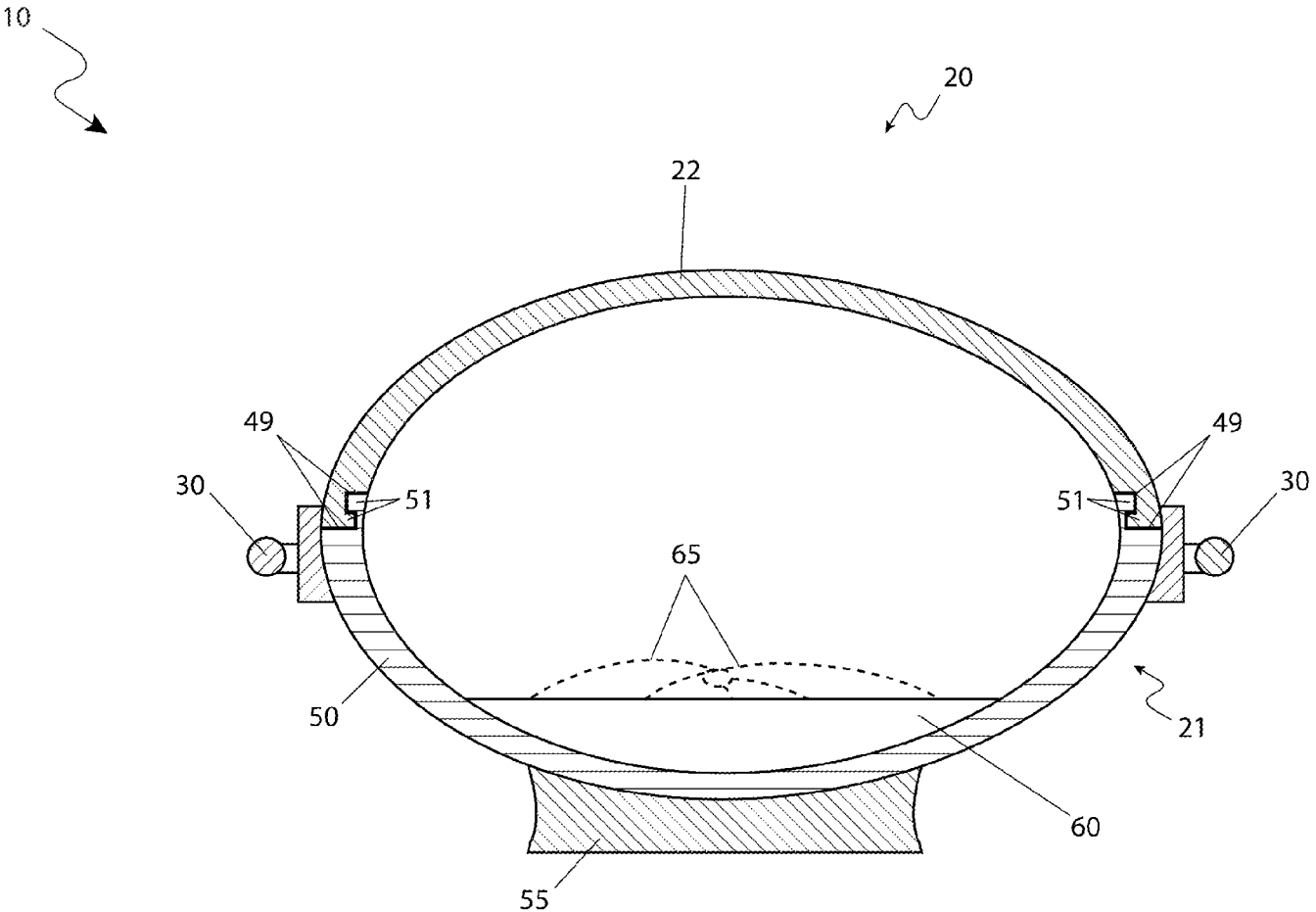
FIG. 5 is a section view of the burial capsule 10 taken along line A-A (see FIG. 1), according to a preferred embodiment of the present invention.

Referring now to FIG. 5, a section view of the apparatus 10 taken along line A-A (see FIG. 1), according to the preferred embodiment of the present invention, is disclosed. The base support 55 is tangential to the base 50 and is comprised of a rectangular portion located lengthwise across an entire bottom portion of said base 50. The base support 55 enables the apparatus 10 to be displayed in a desired level location for viewing or burial means. The base 50 comprises a horizontal surface 60 which provides an interior flat surface for positioning the deceased remains upon. The horizontal surface 60 comprises preferably upholstered bedding which would line an interior portion of the base 50 to provide an aesthetically pleasing décor. The interior of the base portion 50 may also house a variety of ceremonial or highly esteemed items to personalize the apparatus 10 such as, but not limited to: pillows 65, photographs, or the like. The horizontal surface 60 is durable to withstand a deceased individual and may be customizable and available in a variety of fabrics.

An uppermost surface of the base portion 50 and a lowermost surface of a top portion 20 comprise the slide fitting means 51 which provides an interconnecting and securing the two (2) portions 20, 50 together. The slide fitting means 51 is achieved via a common tongue-and-groove type joint which enables the two (2) portions 20, 50 to join strongly together which creates a seamless circular body. A gasket seal 49 is also used in conjunction with the tongue-and-groove type joints and/or an entrapment type joints to thoroughly seal the apparatus 10 in a closed state.

Figure 6:
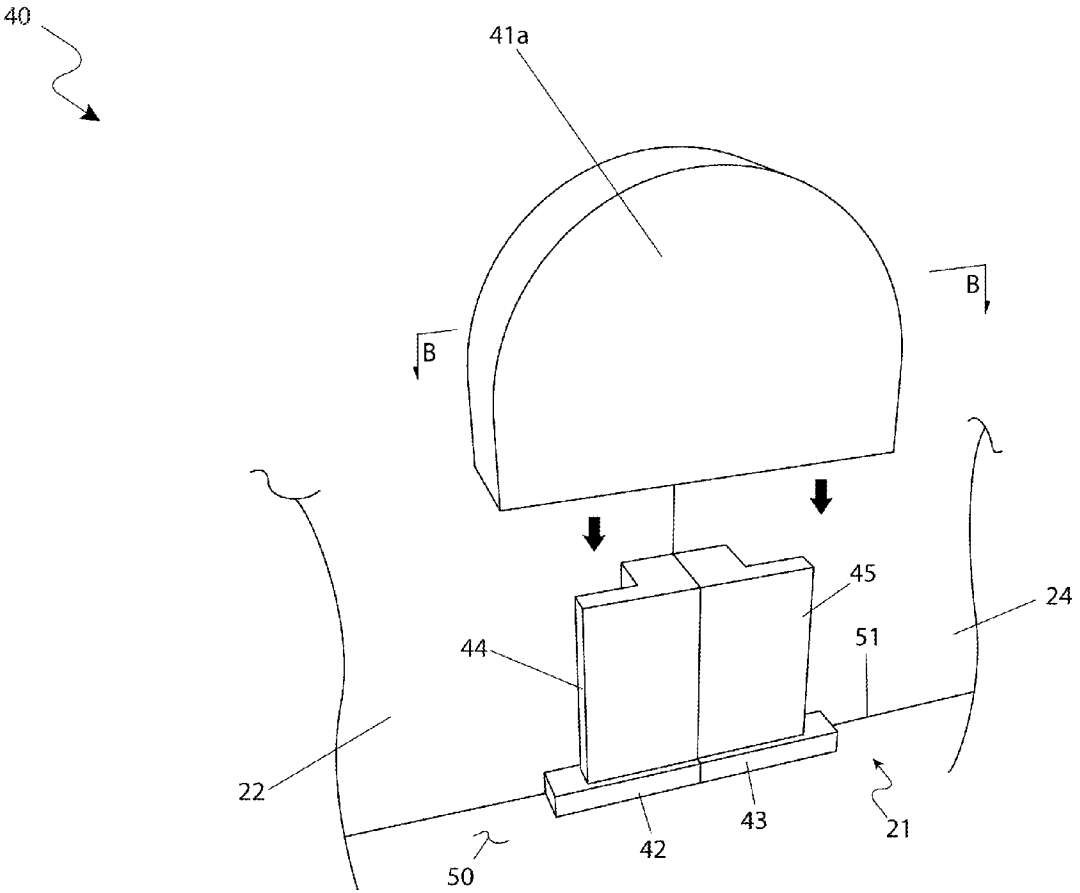
FIG. 6 is a close-up perspective view of a latching means 40, according to a preferred embodiment of the present invention; and, FIG. 7 is a section view of the latching means 40 taken along line B-B (see FIG. 6) according to a preferred embodiment of the present invention.

Referring now to FIG. 6, a close-up perspective view of the latching means 40 and FIG. 7, a section view of a cap 41*a* taken along line B-B (see FIG. 5), according to the preferred embodiment of the present invention, are disclosed. As abovementioned the lids 22, 24 are secured via the latching means 40 which restrict movement of said lids 22, 24 in an x and y axis. The latching means 40 comprises a cap 40, a first ledge 42, a second ledge 43, a first protrusion 44, and a second protrusion 45. The first lid 22 comprises a pair of "T"-shaped first protrusions 44 which are located along each lower outer surface of said first lid 22. Integrally molded below each first protrusion 44 is a rectangular first ledge 42. The second lid 24 comprises a pair of second protrusions 45 which are also "T"-shaped and are located along each lower outer surface of said second lid 24. Integrally molded below each second protrusion 45 is a rectangular second ledge 43. When each lid 22, 24 is engaged upon the lower portion 21 the protrusions 44, 45 and ledges 42, 43 form a seamless body which enables a cap 41*a* to be slidably engaged to secure the lids 22, 24 in the x and y axis. The cap 41*a* comprises a rectangular lower structure further comprising an arcuate upper structure and further comprises a "T"-shaped aperture 41*b* which enables said cap 41*a* to engage the protrusions 44, 45 and rest upon the ledges 42, 43.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIG. 1.

The method of utilizing the apparatus 10 may be achieved by performing the following steps: acquiring the apparatus 10; removing each cap 41*a* from each protrusion 44, 45; sliding the first lid 22 horizontally via the slide fitting means 51, completely removing said first lid 22; sliding the second lid 24 horizontally via the slide fitting means 51, completely removing said second lid 24; placing a deceased individual and other highly esteemed items in an interior portion of the base 50 upon the horizontal surface 60; reinstalling the second lid 24 in a sliding manner to its original position; reinstalling the first lid 22 also in a sliding manner to its original position; slidably engaging each cap 41*a* with each protrusion 44, 45 and resting said cap 41*a* upon each ledge 42, 43, thereby securing the lids 22, 24; grasping at least two (2) opposing handles 30, 35 by at least (2) persons to transport and position the apparatus 10 to a desired location; enabling the apparatus 10 to remain in a closed position; placing the apparatus 10 in a grave or other desired location; and, enjoying the economical and contemporary burial enclosure.

The method of utilizing the apparatus 10 in a partially open state may be achieved by performing the following steps: removing each cap 41*a* from each protrusion 44, 45; sliding a desired lid 22, 24 horizontally, completely removing said desired lid 22, 24; reinstalling said lid 22, 24 as desired; and latching the latching means 40 when necessary.

The method of utilizing the apparatus 10 in a fully open state may be achieved by performing the following steps: removing each cap 41*a* from each protrusion 44, 45; sliding each lid 22, 24 horizontally, completely removing each lid 22, 24; reinstalling each lid 22, 24 as desired; and latching the latching means 40 when necessary.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A burial capsule to display, secure and transport deceased remains, said burial capsule comprising:

a top portion comprising a first lid and a second lid removably connected to said first lid;

a lower portion detachably mated to said top portion, said lower portion comprising a base and a base support coupled thereto, said lower portion adapted to receive the deceased remains;

a slide fitting mechanism for slidably connecting said first lid and said second lid to said lower portion; and, a latching mechanism connected to said first lid and said second lid respectively, said latching mechanism being configured in such a manner that said first lid is detachably fastened to said second lid when said first lid and said second lid lay end-to-end on top of said lower portion;

wherein said top portion is divided equally into first and second halves, wherein said first and second lids define said first and second halves respectively, each said first and second lids having a semi-circular shape such that said first lid minors said second lid, each of said first and second lids being slidably and removably attached to said lower portion via said slide fitting mechanism.

2. The burial capsule of claim 1, wherein said base support is tangential to said base and comprises: a rectangular portion located lengthwise across an entire bottom portion of said base, wherein said base comprises a horizontal surface defining an interior flat surface along said lower portion, said horizontal surface having upholstered bedding lining positioned along an interior portion of said base, wherein an uppermost surface of said base and a lowermost surface of a top portion are engaged with said slide fitting mechanism and thereby interconnected together.

3. The burial capsule of claim 1, wherein said slide fitting mechanism restricts movement of each of said first and second lids in x and y axes respectively.

4. The burial capsule of claim 1, wherein said latching mechanism comprises:

a cap;

first and second ledges connected to said first and second lids respectively; and, first and second protrusions extending upwardly from said first and second ledges respectively;

wherein said cap is provided with a T-shaped aperture that enables said cap to engage said first and second protrusions and thereby rests upon said first and second ledges respectively.

5. The burial capsule of claim 4, wherein when each of said first and second lids is engaged upon said lower portion, then said first and second protrusions and said first and second ledges become suitably oriented such that said cap slidably engages and secures each of said first and second lids in said x and y axes respectively.

6. The burial capsule of claim 1, wherein said latching mechanism further comprises:

a cap;

a T-shaped first protrusion located along each lower outer surface of said first lid;

a rectangular first ledge integrally molded below each of said first protrusions respectively;

a T-shaped second protrusion located along each lower outer surface of said second lid, and, a rectangular second ledge integrally molded below each of said second protrusions respectively wherein said cap is provided with a T-shaped aperture that enables said cap to engage said first and second protrusions and thereby rests upon said first and second ledges respectively.

7. A burial capsule to display, secure and transport deceased remains, said burial capsule comprising:

a top portion comprising a first lid and a second lid removably connected to said first lid;

a lower portion detachably mated to said top portion, said lower portion comprising a base and a base support coupled thereto, said lower portion adapted to receive the deceased remains;

a slide fitting mechanism for slidably connecting said first lid and said second lid to said lower portion;

a gasket seal mated to said slide fitting mechanism; and, a latching mechanism connected to said first lid and said second lid respectively, said latching mechanism being configured in such a manner that said first lid is detachably fastened to said second lid when said first lid and said second lid lay end-to-end on top of said lower portion;

wherein said top portion is divided equally into first and second halves, wherein said first and second lids define said first and second halves respectively, each said first and second lids having a semi-circular shape such that said first lid minors said second lid, each of said first and second lids being slidably and removably attached to said lower portion via said slide fitting mechanism.

8. The burial capsule of claim 7, wherein said base support is tangential to said base and comprises: a rectangular portion located lengthwise across an entire bottom portion of said base, wherein said base comprises a horizontal surface defining an interior flat surface along said lower portion, said horizontal surface having upholstered bedding lining positioned along an interior portion of said base, wherein an uppermost surface of said base and a lowermost surface of a top portion are engaged with said slide fitting mechanism and thereby interconnected together.

9. The burial capsule of claim 8, wherein said slide fitting mechanism restricts movement of each of said first and second lids in x and y axes respectively.

10. The burial capsule of claim 9, wherein said latching mechanism comprises:

a cap;

first and second ledges connected to said first and second lids respectively; and, first and second protrusions extending upwardly from said first and second ledges respectively;

wherein said cap is provided with a T-shaped aperture that enables said cap to engage said first and second protrusions and thereby rests upon said first and second ledges respectively.

11. The burial capsule of claim 10, wherein when each of said first and second lids is engaged upon said lower portion, then said first and second protrusions and said first and second ledges become suitably oriented such that said cap slidably engages and secures each of said first and second lids in said x and y axes respectively.

12. The burial capsule of claim 9, wherein said latching mechanism further comprises:

a cap;

a T-shaped first protrusion located along each lower outer surface of said first lid; and, a rectangular first ledge integrally molded below each of said first protrusions respectively;

a T-shaped second protrusion located along each lower outer surface of said second lid, and, a rectangular second ledge integrally molded below each of said second protrusions respectively wherein said cap is provided with a T-shaped aperture that enables said cap to engage said first and second protrusions and thereby rests upon said first and second ledges respectively.

* * * * *